US011857095B2

(12) United States Patent
Yoon et al.

(10) Patent No.: US 11,857,095 B2
(45) Date of Patent: Jan. 2, 2024

(54) CLOTHES HANGER

(71) Applicant: LG ELECTRONICS INC., Seoul (KR)

(72) Inventors: Jihyun Yoon, Seoul (KR); Jeongjoon Roh, Seoul (KR); Ayeong Lee, Seoul (KR); Tachee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 17/438,641

(22) PCT Filed: Feb. 28, 2020

(86) PCT No.: PCT/KR2020/002912
§ 371 (c)(1),
(2) Date: Sep. 13, 2021

(87) PCT Pub. No.: WO2020/189920
PCT Pub. Date: Sep. 24, 2020

(65) Prior Publication Data

US 2022/0183490 A1 Jun. 16, 2022

(30) Foreign Application Priority Data

Mar. 18, 2019 (KR) ..... 10-20190030463

(51) Int. Cl.
*A47G 25/40* (2006.01)

(52) U.S. Cl.
CPC ..... *A47G 25/4053* (2013.01)

(58) Field of Classification Search
CPC ..... A47G 25/40; A47G 25/4046; A47G 25/4053; A47G 25/44; A47G 25/441; A47G 25/442; A47G 25/443
(Continued)

(56) References Cited

U.S. PATENT DOCUMENTS 2,290,722 A * 7/1942 Weingarten ..... A47G 25/4023 223/94
2,496,561 A * 2/1950 Saunders ..... A47G 25/443 223/94
(Continued)

FOREIGN PATENT DOCUMENTS

KR 20-0446345 10/2009
KR 10-2013-0092907 A 8/2013
(Continued)

OTHER PUBLICATIONS

PCT Search Report issued in International Application No. PCT/KR2020/002912, dated Jun. 9, 2020 (4 pages).

*Primary Examiner* — Nathan E Durham
(74) *Attorney, Agent, or Firm* — Birch, Stewart, Kolasch & Birch, LLP

(57) ABSTRACT

A clothing hanger according to the present disclosure may include a vertical frame, a support frame including a center part connected to an upper end of the vertical frame and a pair of support parts formed from both sides of the center part to support clothing, a moving bar configured to be provided in an inner portion of the vertical frame to be capable of elevating, an elevating body configured to be connected to an upper end of the moving bar and provided in the center part to be capable of elevating, a multi-joint link embedded in the support part and rotatably connected to the elevating body, the length of which varies according to the elevation of the elevating body, and an extension frame connected to the multi joint link, configured to be movable in an inner portion of the support frame and to protrude outward from the support part.

20 Claims, 12 Drawing Sheets

(58) Field of Classification Search
USPC ..... 223/89, 90, 94
See application file for complete search history.

(56) References Cited

U.S. PATENT DOCUMENTS

| | | | | | |
|---|---|---|---|---|---|
| 2,507,906 | A | | 5/1950 | Joseph | |
| 2,757,836 | A | * | 8/1956 | Niedermeyer | A47G 25/443 223/94 |
| 5,456,391 | A | * | 10/1995 | Chang | A47G 25/443 223/89 |
| 5,826,759 | A | * | 10/1998 | Ohsugi | A47G 25/443 223/89 |

FOREIGN PATENT DOCUMENTS

| | | | |
|---|---|---|---|
| KR | 10-2015-0077242 | A | 7/2015 |
| KR | 10-20150103802 | A | 9/2015 |
| KR | 10-2016-0122344 | A | 10/2016 |
| KR | 10-2017-0009479 | A | 1/2017 |
| KR | 10-1811318 | B1 | 12/2017 |
| KR | 10-1848305 | B1 | 4/2018 |

* cited by examiner

CLOTHES HANGER

CROSS-REFERENCES TO RELATED APPLICATIONS

This application is the National Stage filing under 35 U.S.C. 371 of International Application No, PCT/KR2020/002912, filed on Feb. 28, 2020, which claims the benefit of earlier filing date and right of priority to Korean Application No. 10-2019-0030463 filed on Mar. 18, 2019, The contents of all the above-referenced applications are hereby incorporated by reference herein in their entirety.

TECHNICAL FIELD

The present disclosure relates to a clothing hanger.

BACKGROUND ART

A clothing hanger is a device for hanging clothing. In general, the clothing hanger may Include a hook and a hanging part formed to be inclined downward from the lower end of the hook to both sides. The hook may be hung and suspended on a holder such as a wardrobe, and clothing may be hung and supported on the hanging part.

The functional clothing hanger may have a variable structure for the convenience of use or prevention of damage to clothing. For example, the clothing hanger disclosed in Prior Document 1 (KR10-181138B1, entitled "One-touch folding clothing hanger," registered on Dec. 15, 2017) is capable of adjusting the length of the shoulder holding part, and in the clothing hanger disclosed in Prior Document 2 (KR10-2017-0009479A, entitled "Multifunctional clothing hanger," published on Jan. 25, 2017), the angle of the shoulder hanging part and the unfolding support part can be adjusted.

SUMMARY

Technical Problem

An object to be solved by the present disclosure is to provide a clothing hanger that can be extended in the left and right direction to support clothing of various sizes.

Another object to be solved by the present disclosure is to provide a clothing hanger capable of keeping the clothing taut by applying a mechanical force to the clothing.

Another object to be solved by the present disclosure is to provide a clothing hanger that easily extends in the left and right direction and returns to the original state thereof.

Technical Solution

A clothing hanger according to an embodiment of the present disclosure may include a vertical frame, a support frame including a center part connected to an upper end of the vertical frame and a pair of support parts formed long from both sides of the center part to support clothing, a moving bar configured to be provided in an inner portion of the vertical frame to be capable of elevating, an elevating body configured to be connected to an upper end of the moving bar and provided in the center part to be capable of elevating, a multi joint link which is embedded in the support part and rotatably connected to the elevating body, and the length of which varies according to the elevation of the elevating body, and an extension frame configured to be provided to be removable in an inner portion of the support frame, to be connected to the multi-joint link, and to protrude outward from the support part.

The clothing hanger may further include a handle configured to be connected to the lower end of the moving bar and to be located below the vertical frame.

The support frame may further include an upper body fastened on the upper side of the center part and having an inner space in which the elevating body is capable of lifting, and a hook may be provided on the upper portion of the upper body.

The upper body may be provided with an elastic band which is elastically deformed and surrounds at least a portion of the upper body.

The clothing hanger may further include a band fixing device which is fastened at the front of the upper body and fixes the elastic band.

The clothing hanger may further include an elastic member providing an upward elastic force to the moving bar.

The clothing hanger may further include a stopper configured to prevent the lifting of the moving bar. The stopper may include a button provided on the outer surface of the vertical frame, a stopper main body formed long from the button in the horizontal direction and configured to pass through the vertical frame, and a protrusion configured to protrude from the stopper main body and to hang on the hanging part of the moving bar.

A plurality of hanging parts may be formed, and the plurality of hanging parts may be located at different heights from each other.

The clothing hanger may further include a compression spring configured to provide an elastic force to the stopper in a direction in which the protrusion hangs on the hanging part.

The hanging part may include a horizontal surface on which the protrusion hangs, and an inclined surface connected to the horizontal surface and configured to press the protrusion in a direction in which the stopper compresses the compression spring.

The clothing hanger may further include a pair of lower frames configured to be connected to the lower part of the vertical frame, and a lower extension frame provided movably in the inner portion of the lower frame and configured to protrude to the outside of the lower frame.

The clothing hanger may further include a side frame formed long in the vertical direction and configured to connect the extension frame and the lower extension frame to each other.

The side frame may be elastically deformable.

The clothing hanger may further include a tension spring configured to be embedded in the lower frame and to pull the lower extension frame into the lower frame.

The clothing hanger may further include a stopper configured to prevent the lower extension frame from moving into the lower frame. The stopper may include a button provided on an outer surface of the lower frame, a main body formed long in the horizontal direction from the button and configured to pass through the lower frame, and a protrusion configured to protrude from the main body and to hang to the hanging part of the lower extension frame.

A plurality of hanging parts may be formed, and a plurality of hanging parts may be formed at different positions in a longitudinal direction of the lower extension frame.

The clothing hanger may further include a compression spring configured to press the stopper in a direction in which the protrusion hangs on the hanging part.

The hanging part may include a vertical surface on which the protrusion hangs, and an inclined surface connected to the vertical surface and configured to press the protrusion in a direction in which the stopper compresses the compression spring.

The clothing hanger may further include a lower hook configured to be located on the upper side of the lower frame, a first connecting member configured to be rotatably connected to the lower hook and the lower frame, respectively, and a second connection member configured to be rotatably connected to the lower hook and the lower extension frame, respectively.

A connector to which the second connection member may be rotatably connected is formed on the upper surface of the lower extension frame, and a long hole through which the connector passes may be formed on the upper surface of the lower frame.

A clothing hanger according to an embodiment of the present disclosure may include a vertical frame, a support frame including a center part connected to an upper end of the vertical frame and a pair of support parts formed long from both sides of the center part to support clothing, a moving bar configured to be provided to be capable of elevating in an inner portion of the vertical frame, a multi-joint link which is embedded in the support part, which is rotatably connected to the moving bar, and the length of which varies according to the elevation of the moving bar, and an extension frame configured to be provided movably inside the support frame, to be connected to the multi-joint link, and to protrude outward from the support part.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the disclosed embodiments may be practiced. These embodiments are described in sufficient detail to enable those skilled in the art to practice the disclosed embodiments, and it is understood that other embodiments may be utilized and that logical structural, mechanical, electrical and chemical changes may be made without departing from the spirit or scope of the disclosed embodiments. To avoid detail not necessary to enable those skilled in the art to practice the disclosed embodiments, the description may omit certain information known to those skilled in the art. The following detailed description is, therefore, not to be taken in a limiting sense.

Also, in the description of embodiments, terms such as first, second, A, B, (a), (b) or the like ray be used herein when describing components of the disclosed embodiments. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Hereinafter, specific embodiments of the present disclosure will be described in detail with drawings.

The clothing referred to in this specification includes not only clothing and apparel, but also objects that can be worn by a person, such as shoes, socks, gloves, hats, and scarves, as well as objects that can be used by a person such as dolls, towels, and blankets, and includes all objects that can perform washing.

Figure 1:
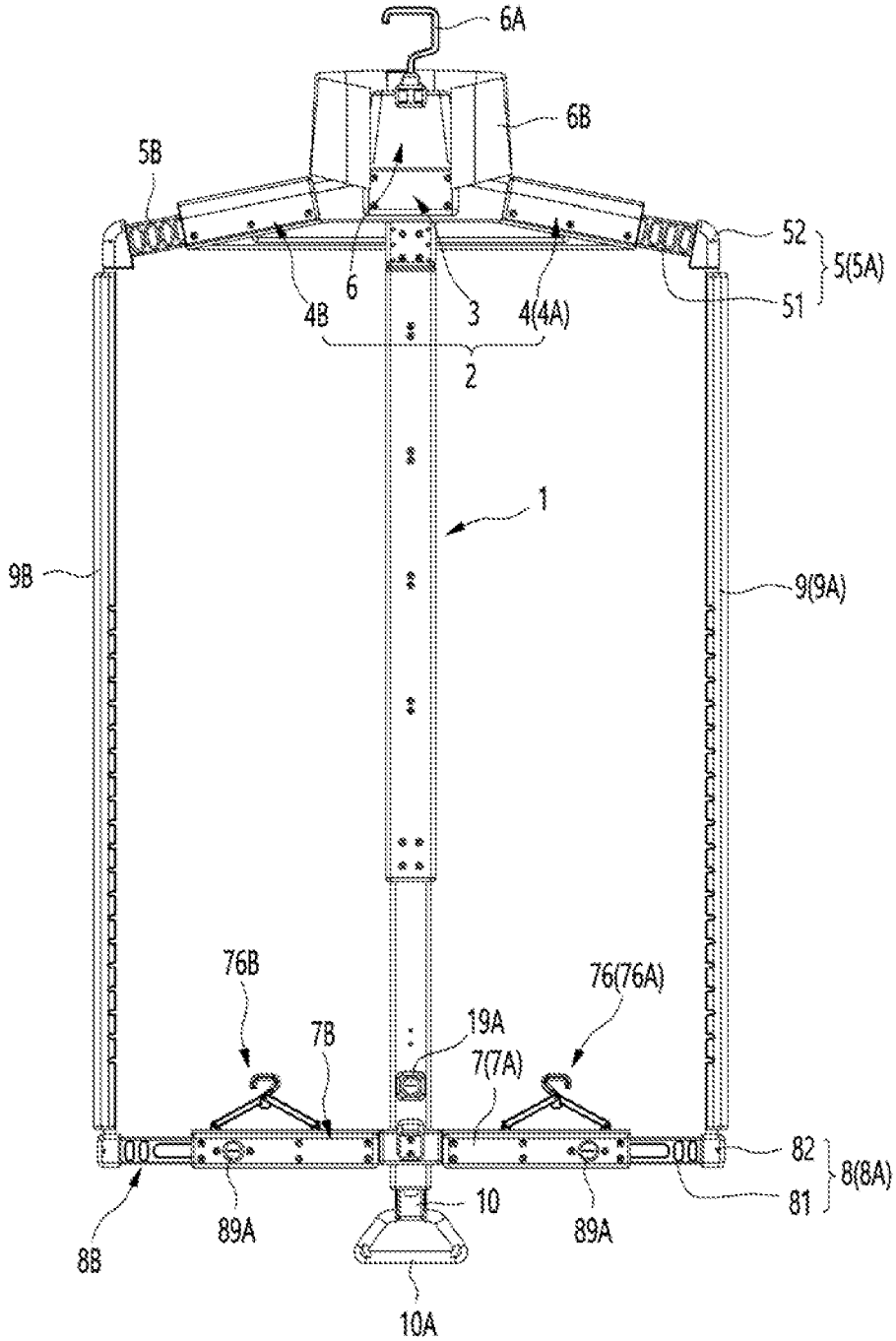
FIG. 1 is a front view illustrating a clothing hanger according to an embodiment of the present disclosure.

FIG. 1 is a front view illustrating a clothing hanger according to an embodiment of the present disclosure.

The clothing hanger according to an embodiment of the present disclosure ay include a vertical frame 1, a support frame 2, an extension frame 5 and a moving bar 10.

The vertical frame ay be formed long in the vertical direction. A space in which the moving bar 10 to be described later is received may be formed inside the vertical frame 1.

The support frame 2 may be connected to the upper end of the vertical frame 1. The support frame 2 may support clothing.

In more detail, the support frame 2 may include a center part 3 connected to the upper end of the vertical frame 1 and a pair of support parts 4 formed long from both sides of the center part 3 to support clothing. In addition, the support frame 2 may further include an upper body 6 fastened to the upper side of the center part 3.

The center part 3 may be located in the center of the support frame 2. The center part 3 may be fastened to the upper end of the vertical frame 1 from the upper side of the vertical frame 1.

A space in which the elevating body 30 (see FIG. 2) to be described later is received may be formed inside the center part 3.

The support part 4 may support the shoulder portion of the clothing. The support part 4 may be formed to be formed long in an inclined direction such that the height of the support part is lowered as the distance from the center part 3 is increased.

The pair of support parts 4 may include a first support part 4A located on one side of the center part 3 and a second support part 4B located on the other side of the center part 3.

A space for receiving the multi-joint link 40 (see FIG. 2) and the extension frame 5 connected to the multi-joint link 40 may be formed inside the support part 4.

The upper body 6 may be fastened to the center part 3 from the upper side of the center part 3. An inner space in which the elevating body 30 (see FIG. 2) can lift may be formed inside the upper body 6. In other words, the inner space of the upper body 6 may communicate with the inner space of the center part 3.

A hook 6A of the upper body 6 may be provided. The hook 6A may be connected to the upper portion of the upper body 6. The hook 6A may be hung on a holder such as a wardrobe to support the entire clothing hanger.

The upper body 6 may be provided with an elastic band 66. The elastic band 66 may surround at least a portion of the upper body 6 from the rear. The height of the elastic band 66 may be higher than the height of the upper body 6.

The elastic band 6B is elastically deformed and can support the collar of clothing. The elastic band 6B may surround the unfolded collar of the clothing from the outside.

The elastic band 66 may be fixed by a ban fixing device 60 (see FIG. 12) to be described later.

The extension frame 5 may be movably provided inside the support frame 2. In some detail, the extension frame 5 may be provided movably inside the support part 4 of the support frame 2 and may protrude to the outside of the support part 4.

The extension frame 5 may be formed long in a direction parallel to the support part 4. The extension frame 5 together with the support part 4 can support the clothing.

The extension frame 5 may protrude from the support part 4. The length at which the extension frame 5 protrudes from the support part 4 may be adjusted according to the operation of the moving bar 10 and the handle 10A, which will be described later. Accordingly, the extension frame 5 can stably support clothing having various sizes.

A pair of extension frames 5 may be provided. The pair of extension frames 5 may include a first extension frame 5A protruding from the first support part 4A and a second extension frame 5B protruding from the second support part 4B. The first extension frame 5A may be formed long in a direction parallel to the first support part 4A. The second extension frame 5B may be formed long in a direction parallel to the second support part 46.

Each extension frame 5 may include an insertion part 51 inserted into the support part 4, and a hanging part 52 formed at are end of the insertion part 51.

The insertion part 51 may be formed in a size to be inserted into the inside of the support part 4. The insertion part 51 may be formed long in a direction parallel to the support part 4. The hanging part 52 may be formed in a size that is not inserted into the inside of the support part 4. The hanging part 52 may be hung on the end of the support part 4 and not be inserted into the support part 4.

The moving bar 10 may be provided so as to be capable of elevating inside the vertical frame 1. The moving bar 10 may be formed long in the vertical direction in parallel with the vertical frame 1.

The lower end of the moving bar 10 may protrude downward of the vertical frame 1.

A handle 10A may be connected to the lower end of the moving bar 10. The handle 10A may be located on the lower side of the vertical frame 1. The user can lower the moving bar 10 by pulling the handle 10A, and, by means of the elevating body 30 (see FIG. 2) and the multi-joint link 40 (see FIG. 2) connected to the moving bar 10. A pair of extension frames 5 may protrude from both sides of the support frame 2, respectively.

Meanwhile, the clothing hanger according to the embodiment of the present disclosure may further include a lower frame 7, a lower extension frame 8, and a side frame 9.

The lower frame 7 may be connected to the lower portion of the vertical frame 1.

The lower frame 7 may be formed long in the left and right direction. The lower frame 7 is preferably disposed horizontally. The lower frame 7 may be spaced downward from the support frame 2, more specifically the support part 4.

A space in which the tension spring 70 (see FIG. 2) and the lower extension frame 8 connected to the tension spring 70 are received may be formed in the lower frame 7.

A pair of lower frames 7 may be provided. The pair of lower frames 7 may include a first lower frame 7A located at one side of the vertical frame 1 and a second lower frame 7B located at the other side of the vertical frame 1. The first lower frame 7A may be vertically overlapped with the first supporting part 4A, and the second lower frame 7B may be vertically overlapped with the second supporting part 4B.

The lower extension frame 8 may be movably provided inside the lower frame 7. The lower extension frame 8 may protrude outward of the lower frame 7.

The lower extension frame 8 may be formed long in a direction parallel to the lower frame 7.

The lower extension frame 8 may protrude from the lower frame 7. The user can pull the lower extension frame 8 to protrude the lower extension frame 8 from the lower frame 7. Accordingly, the direction of the side frame 9, which will be described later, can be appropriately changed according to the shape of the clothing, and the side frame 9 can smoothly apply the mechanical force from the inside of the clothing in the left and right direction.

A pair of lower extension frames 8 may be provided. The pair of lower extension fames 8 may include a first lower extension frame 8A protruding from the first lower frame 7A, and a second lower extension frame 8B protruding from the second lower frame 7B.

Each lower extension frame 8 may include an insertion part 81 inserted into the lower frame 7, and a hanging part 82 formed at an end portion of the insertion part 81.

The insertion part 81 may be formed in a size to be inserted into the lower frame 7. The insertion part 81 may be formed long in a direction parallel to the lower frame 7. The hanging part 82 may be formed in a size not to be inserted into the lower frame 7. The hanging part 82 may not be inserted into the lower frame 7 by being hung on the end part of the lower frame 7.

The side frame 9 may be formed long in the vertical direction.

The side frame 9 may connect the extended frame 5 and the lower extended frame 8. In more detail, the side frame 9 may connect the hanging part 52 of the extension frame 5 and the hanging part 82 of the lower extension frame 8 to each other.

The side frame 9 may be elastically deformed. The side frame 9 may include a non-metal material. A plurality of vertically spaced grooves may be formed in the side frame 9. As a result, the side frame 9 may be elastically deformed to suit the shape of the clothing, and a mechanical force may be applied thereto.

A pair of side frames 9 may be provided. The pair of side frames 9 may include a first side frame 9A and a second side frame 9B. The first side frame 9A may connect the first extended frame 5A and the first lower extended frame 8A. The second side frame 9B may connect the second extended frame 5B and the second lower extended frame 8B.

The first side frame 9A may be located on one side of the vertical frame 1, and the second side frame 9B may be located on the other side of the vertical frame 1. The first side frame 9A and the second side frame 9B may overlap the vertical frame 1 in the left and right direction.

The side frame 9 can apply a mechanical force to both sides of the clothing. In more detail, the side frame 9 may apply a mechanical force from the inside to the outside of the body of the clothing hung on the clothing hanger. Accordingly, the clothing may be kept taut, and refresh operations such as ironing may be performed smoothly.

Meanwhile, the first button 19A may be located on the outer surface of the vertical frame 1. The first button 19A may be located on the lower front surface of the vertical frame 1. The first button 19A may be included in the first stopper 19 (see FIG. 7) that prevents the moving bar 10 from lifting. When the user presses the first button 19A, the moving bar 10 lifts by the elastic force of the elastic member 12 (see FIG. 2), and the extension frame 5 can be inserted into the support part 4 of the support frame 2. This will be described in detail later.

A second button 89A may be located on the outer surface of the lower frame 7. The second button 89A may be located on the front surface of the lower frame 7. The second button 89A may be provided in the first lower frame 7A and the second lower frame 7B, respectively.

The second button 89A may be included in a second stopper 89 (see FIG. 11) that prevents the lower extension frame 8 from moving toward the vertical frame 1. When the user presses the second button 89A, the lower extension frame 8 moves toward the vertical frame 1 by the elastic force of the tension spring 70 (see FIG. 2) to be inserted into the lower frame 7. This will be described in detail later.

A hook device 76 for applying mechanical force by pulling the lower portion of the clothing may be provided on the upper side of the lower frame 7. In one example, the hook device 76 may directly pull the lower portion of the clothing. As another example, a separate clip may be connected to the hook device 76 and the clip may pull the lower portion of the clothing.

The hook device 76 may have a variable height according to the degree of protrusion of the lower extension frame 8 with respect to the lower frame 7. Accordingly, it is possible to smoothly apply mechanical force to the lower portion of the clothing having various heights. This will be described in detail later.

Figure 2:
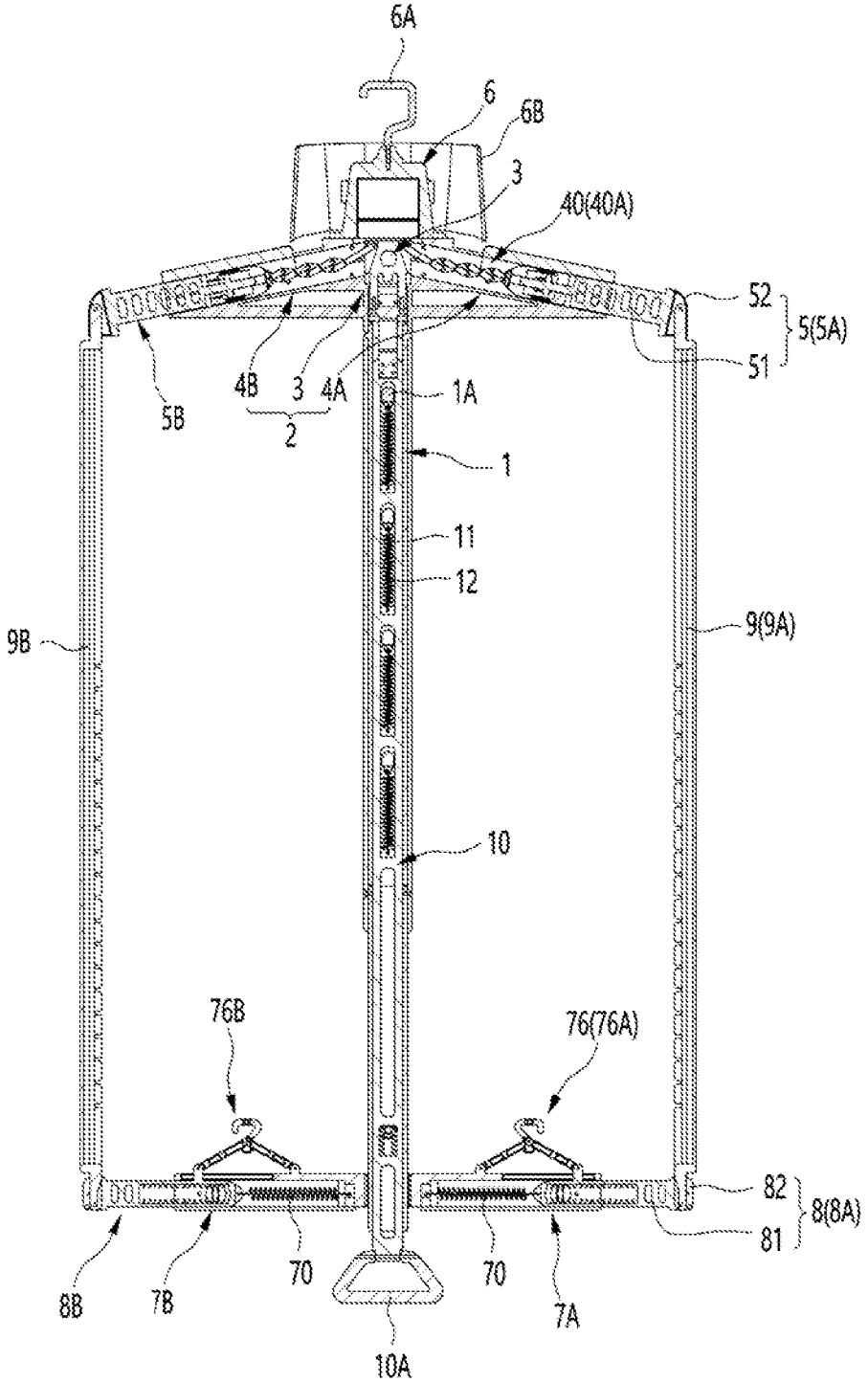
FIG. 2 is a cross-sectional view illustrating the inside of the clothing hanger according to an embodiment of the present disclosure.

FIG. 2 is a cross-sectional view illustrating the inside of the clothing hanger according to an embodiment of the present disclosure.

The clothing hanger according to an embodiment of the present disclosure may further include an elevating body 30 and a multi-joint link 40.

The elevating body 30 may be connected to the upper end of the moving bar 10 and may be elevated together with the moving bar 10. The elevating body 30 may be integrally formed with the moving bar 10.

The elevating body 30 may be provided to be capable of elevating in the center part 3 of the support frame 2. In more detail, the elevating body 30 may lower into the inner space of the center part 3 or lift into the inner space of the upper body 6.

A pair of multi-joint links 40 may be rat ably connected to both sides of the elevating body 30, respectively.

The multi-joint link 40 may be built into the support part 4. The multi-joint link 40 is rotatably connected to the elevating body 30 and may have a variable length according to the elevation of the elevating body 30. The multi-joint link 40 may be bellows.

The multi-joint link 40 may connect the elevating body 30 and the extension frame 5 to each other.

When the moving bar 10 and the elevating body 30 lift, the length of the multi-joint link 40 may be shortened, and the multi-joint link 40 may pull the extension frame 5. Thus, the extension frame 5 can be inserted into the support part 4 of the support frame 2.

Conversely, when the moving bar 10 and the elevating body 30 lower, the length of the multi-joint link 40 may increase as illustrated in FIG. 2, and the multi-joint link 40 may push the extension frame 5. Accordingly, the extension frame 5 may protrude from the support part 4 of the support frame 2.

However, the present disclosure is not limited thereto, and it is also possible that the rotation link 40 is rotatably directly connected to the upper end portion of the moving bar 10. In this case, the upper end portion of the moving bar 10 is located inside the center part 3, and the clothing hanger may not include the elevating body 30.

Meanwhile, at least one long hole 11 may be formed in the moving bar 10, and an elastic member 12 may be disposed in each elongated hole 11. The long hole 11 may be formed long in the vertical direction. The elastic member 12 may provide an upward direction to the moving bar 10. The elastic member 12 may be a tension spring or a compression spring.

An insertion protrusion 1A to which the elastic member 12 is connected may be provided inside the vertical frame 1. The insertion protrusion 1A may be inserted into the long hole 11 of the moving bar 10. The insertion protrusion 1A may be formed to protrude from the inner surface of the vertical frame 1 toward the long hole 11.

The elastic member 12 may be located between the insertion protrusion 1A and the long hole 11.

The elastic member 12 may be located in at least one of between the lower end of the long hole 11 and the insertion protrusion 1A and between the upper end of the long hole 11 and the insertion protrusion 1A. In other words, the elastic member 12 may be located below and/or above the insertion protrusion 1A.

In this case, when the moving bar 10 lowers with respect to the vertical frame 1, the upper end of the long hole 11 may be close to the insertion protrusion 1A, and the elastic member 12 may be compressed or tensioned. Accordingly, the elastic member 12 may provide an upward elastic force to the moving bar 10 by the restoring force of the elastic member 12.

Meanwhile, the tension spring 70 may be built in the lower frame 7. The tension spring 70 may provide an elastic force to the lower extension frame 8 in an inward direction of the lower frame 7.

In more detail, when the lower extension frame 8 moves outward, the tension spring 70 may be tensioned. Accordingly, the tension spring 70 may pull the lower extension frame 8 in a direction closer to the vertical frame 1 by the compressed restoring force.

Figure 3:
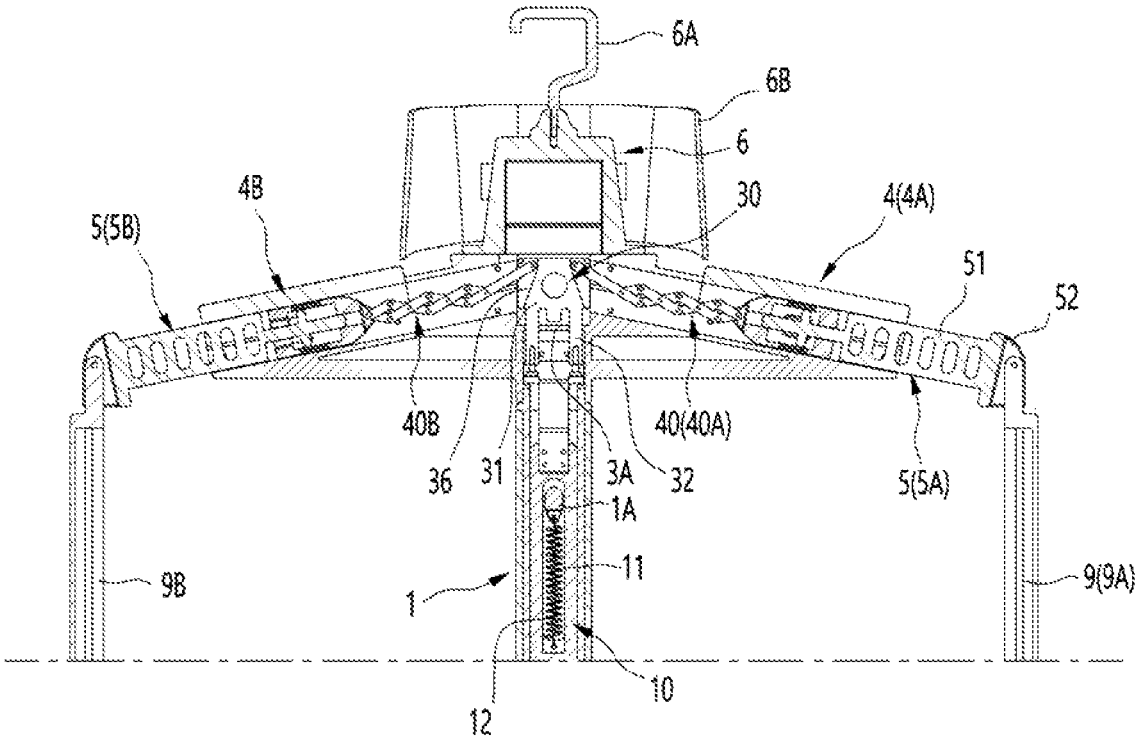
FIG. 3 is an enlarged cross-sectional view illustrating the inside of the upper portion of the clothing hanger according to an embodiment of the present disclosure.
Figure 4:
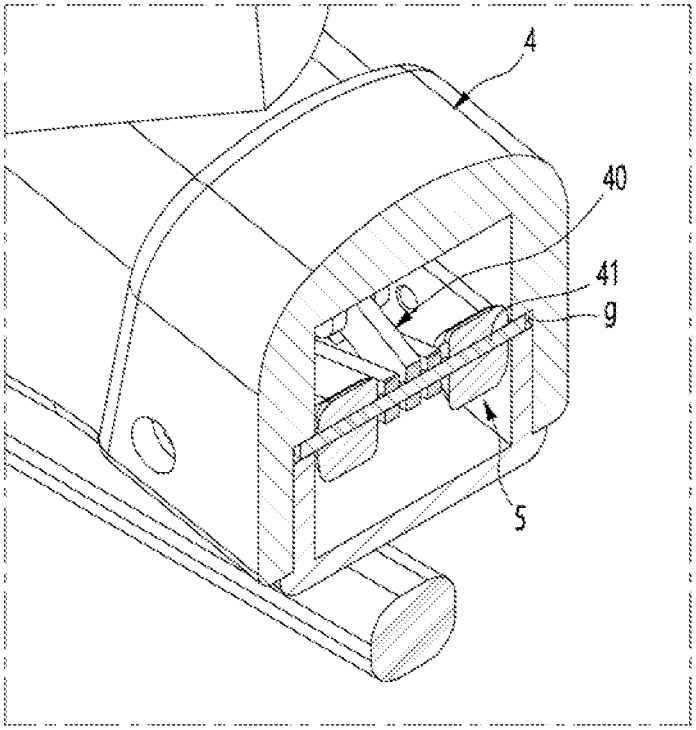
FIG. 4 is a view for explaining a configuration in which the extension frame is guided according to an embodiment of the present disclosure.
Figure 5:
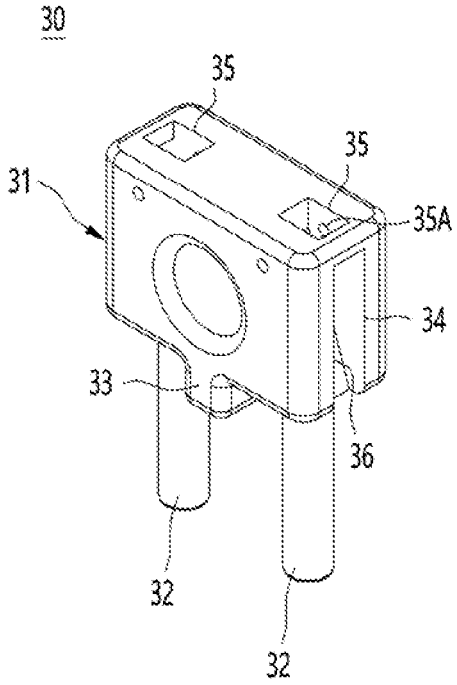
FIG. 5 is a perspective view illustrating an elevating body according to an embodiment of the present disclosure.

FIG. 3 is an enlarged cross-sectional view illustrating the inside of the upper portion of the clothing hanger according to an embodiment of the present disclosure, FIG. 4 is a view for explaining a configuration in which the extension frame is guided according to an embodiment of the present disclosure, and FIG. 5 is a perspective view illustrating an elevating body according to an embodiment of the present disclosure.

The elevating body 30 may include a main body 31 and a roving bar connector 32 protruding downward from the main body 31.

The main body 31 may have a block shape. The moving bar connector 32 may protrude downward from the bottom surface of the main body 31. It is preferable that a plurality of moving bar connectors 32 are formed.

The support part 3 may include a stop plate 3A for limiting the levering range of the elevating body 30. The stop plate 3A may form the bottom surface of the support part 3 but is not limited thereto.

In more detail, a protrusion part 32 protruding downward from the main body 31 may be formed on the elevating body 30. The elevating body 30 may lower until the protrusion part 32 comes into contact with the upper surface of the stop plate 3A.

The moving bar connector 32 may be connected to the upper end of the moving bar 10 through the stop plate 3A of the support part 3. Since the elevating body 30 elevates in a state where the moving bar connector 32 passes through the stop plate 3A, the moving bar connector 32 may be formed to be sufficiently long. The vertical length of the moving bar connector 32 may be longer than the length of the protrusion part 33 in the vertical direction.

A gradient surface 36 may be formed on the main body 31 of the elevating body 30. A pair of gradient surfaces 36 may be formed. A pair of gradient surfaces 36 may guide a pair of multi-joint links 40, respectively.

The gradient surface 36 may be formed to be inclined in a direction in which the height decreases as it approaches the side surface of the elevating body 30.

In more detail, a link passage groove 34 through which the multi-joint link 40 passes is formed on the side surface of the body 31, and a through-hole 35 communicating with the link passage groove 34 may be formed on the upper surface of the main body 31. The gradient surface 36 may be formed to connect the lower end of the through-hole 35 from the lower end of the link passage groove 34.

The link passage groove 34 may be formed long in the vertical direction. A link connection hole 35A to which the multi-joint link 40 its rotatably connected may be formed in the through-hole 35A.

When the elevating body 30 lifts, the multi-joint link 40 may approach the gradient surface 36, and when the elevating body 30 lowers, the multi-joint link 40 may move away from the inclined surface 36.

The length of the multi-joint link 40 may be smoothly varied according to the elevation of the elevating body 30 by the gradient surface 36.

Meanwhile, a guide groove g formed long in the direction of the support part 4 may be formed inside the support part 4 of the support frame 2. The guide groove g may be formed long on both surfaces of the inner side of the support part 4. The guide groove g may guide the multi-joint link 40 and the extension frame 5.

In more detail, the lower end part of the support link 40 may be rotatably connected to the extension frame 5 by the rotation shaft 41. Both ends of the rotation shaft 41 may be inserted into the guide groove g. Therefore, when the length of the rotation link 40 is changed, the rotation shaft 41 can move along the guide groove g. Accordingly, the guide groove g can guide the multi-joint link 40 and the extension frame 5 connected to the rotation shaft 41.

Figure 6:
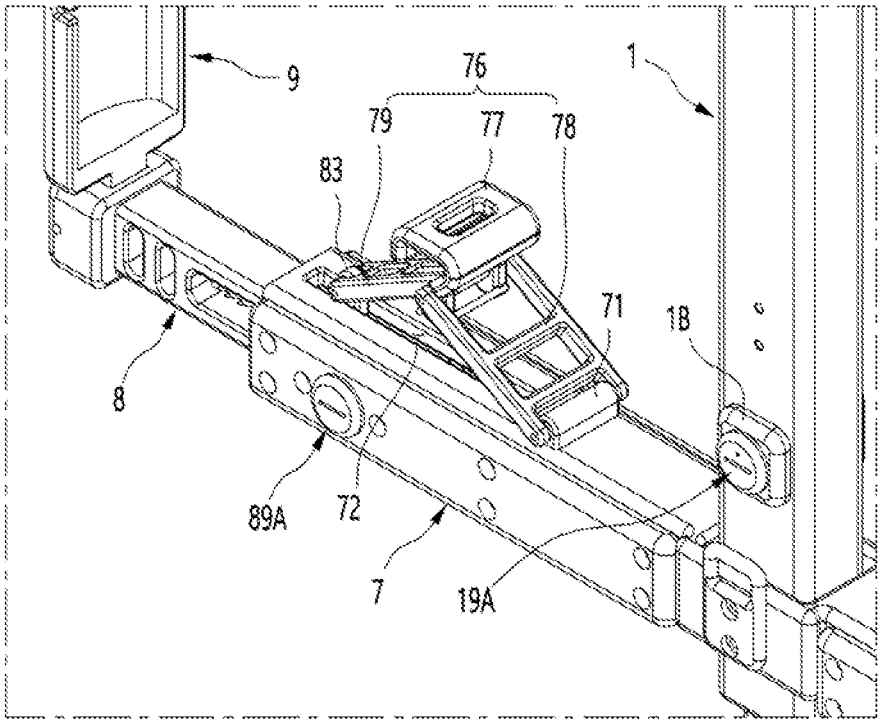
FIG. 6 is an enlarged view illustrating a portion of a lower side of a clothing hanger according to an embodiment of the present disclosure.

FIG. 6 is an enlarged view illustrating a portion of a lower side of a clothing hanger according to an embodiment of the present disclosure.

The hook device 76 may include a lower hook 77, a first connection member 78, and a second connection member 79.

The lower hook 77 may be located on the upper side of the lower frame 7. The first connecting member 78 may be rotatably connected to each of the lower hook 77 and the lower frame 7. The second connecting member 79 may be rotatably connected to each of the lower hook 77 and the lower extension frame 8.

The lower hook 77 may be connected to the lower end of the clotting to apply a mechanical force to the lower end of the clothing. For example, a separate clip (not illustrated) may be hung on the lower hook 77, and the clip may pull the lower portion of the clothing.

The first connection member 78 may be disposed to be inclined in a direction in which the height decreases as it approaches the vertical frame 1. One end of the first connection member 78 may be rotatably connected to the first connector 71 formed on the upper surface of the lower frame 7. The other end of the first connecting r ember 78 may be rotatably connected to the lower hook 77.

The second connecting member 79 may be disposed to be inclined in a direction in which the height decreases as the distance from the vertical frame 1 increases. One end of the second connection member 79 may be rotatably connected to the second connector 83 formed on the upper surface of the lower extension frame 8. The other end of the second connection member 79 may be rotatably connected to the lower hook 77.

A long hole 72 through which the second connector 83 passes may be formed on the upper surface of the lower frame 7. The long hole 72 may be formed long in the longitudinal direction of the lower frame 7.

With the above configuration, when the lower extension frame 8 protrudes from the lower frame 1, the inclination of the first connecting member 78 and the second connecting member 79 can be gentle, and the distance between the lower frame 7 and the lower hook 77 in the vertical direction may be reduced. As a result, the hook device 76 may apply a mechanical force downward to the clothing connected to the lower hook 77, and the clothing may become taut.

Figure 7:
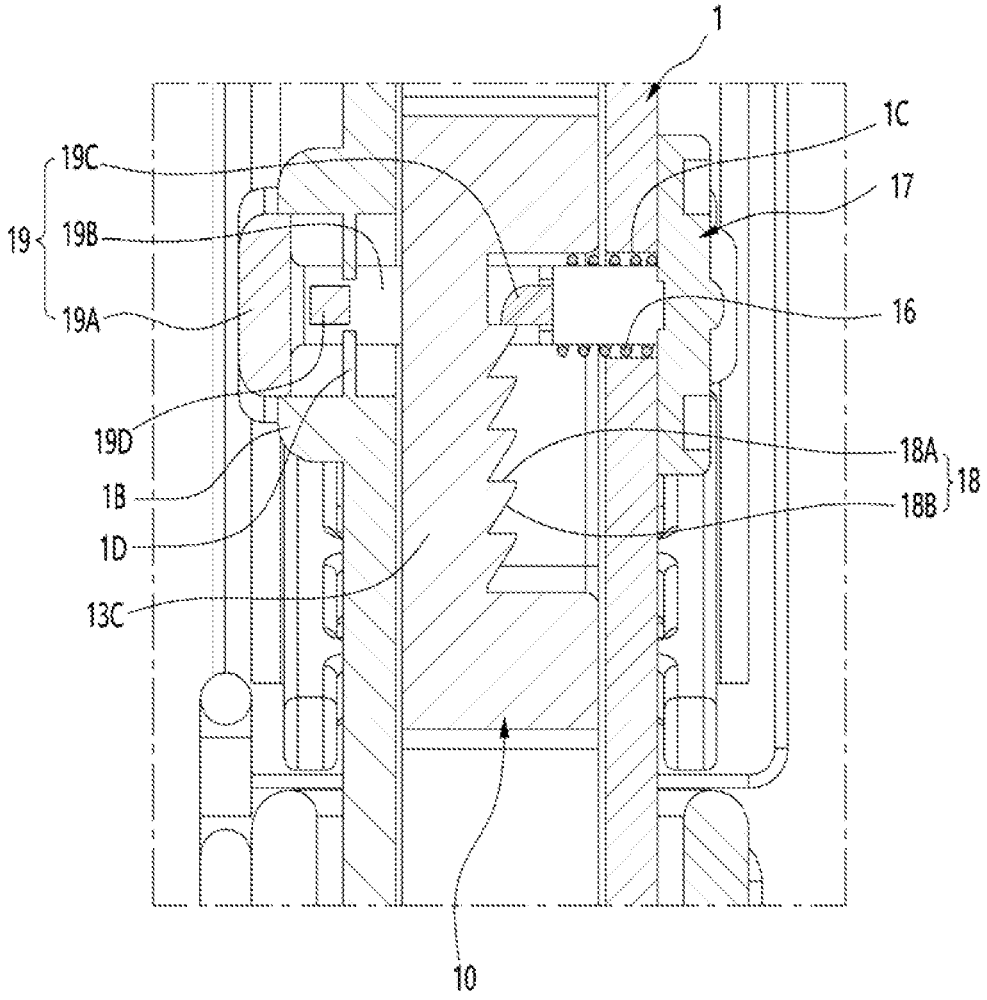
FIG. 7 is a view for explaining the operation of a first stopper according to an embodiment of the present disclosure.
Figure 8:
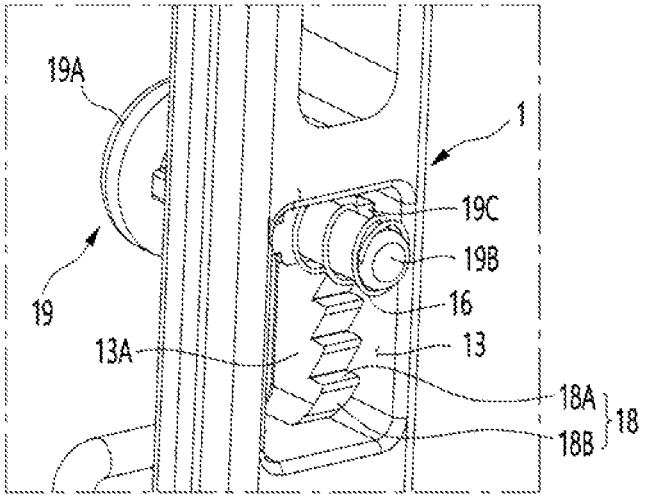
FIG. 8 is a view illustrating a connection relationship between a first stopper and a moving bar according to an embodiment of the present disclosure.

FIG. 7 is a view for explaining the operation of a first stopper according to an embodiment of the present disclosure, and FIG. 8 is a view illustrating a connection relationship between a first stopper and a moving bar according to an embodiment of the present disclosure.

The clothing hanger according to an embodiment of the present disclosure ray include a first stopper 19 that prevents the moving bar 10 from lifting.

The first stopper 19 may include a first button 19A provided on the outer surface of the vertical frame 1, a first stopper main body 198 formed long in the horizontal direction from the first button 19A, and a protrusion 19C protruding from the first stopper main body 198 and hung on the moving bar 10.

The first button 19A may be provided on the outer surface of the vertical frame 1. In more detail, a stopper mounting part 18 to which the first stopper 19 is mounted may be formed on the vertical frame 1. The stopper mounting part 18 may have a hollow cylindrical shape protruding forward from the lower front surface of the vertical frame 1.

The stopper mounting part 1B may surround the outer circumference of the first button 19A. The inside of the stopper mounting part 1B may communicate with the internal space of the vertical frame 1.

The first stopper 19 may be mounted to the stopper mounting part 1B to be movable in the horizontal direction, in more detail, in the front and rear direction. When the user presses the first button 19A, the first stopper 19 can move rearward, and when the user does not apply a force to the first button 19A, the first stopper can move forward by the elastic force of the first compression spring 16.

The first stopper main body 19B may be formed long rearward from the first button 19A. The diameter of the first stopper main body 19B may be smaller than the diameter of the first button 19A.

The first stopper main body 19B may pass through the vertical frame 1. In more detail, the first stopper main body 19B may be formed long from the inner portion of the button mounting part 1B to pass through the through-hole 1C formed on the rear surface of the vertical frame 1. In addition, an opening 13 through which the first stopper main body 19B passes may be formed in the moving bar 10. The opening 13 may be a long hole that passes through in the front and rear direction and is formed long in the vertical direction. In addition, a connection cover 17 to cover the through-hole 1C and to which the rear end of the first stopper main body 196 is connected may be provided on the rear surface of the vertical frame 1.

The protrusion 19C may protrude radially outward from the first stopper main body 19B. In more detail, the protrusions 19C may protrude from the first stopper main body 19B to both left and right sides. The protrusion 19C may be hung by the hanging part 18 formed on the moving bar 10. FIG. 7 illustrates a state where the moving bar 10 lowers to the maximum and the protrusion 19C is hung by the uppermost hanging part 18.

The hanging part 18 may be formed in the open hole 13 of the moving bar 10. In more detail, the protruding body 13A is formed on both sides of the inner circumference of the open hole 13, and a plurality of hanging parts 18 may be formed on the rear surface of the protruding body 13A.

The pair of protruding bodies 13A may protrude in a direction closer to each other on both sides of the inner circumference of the opening 13. The protruding body 13A may be formed long in the vertical direction.

The hanging part 18 may be formed to protrude rearward from the rear surface of the protruding body 13A.

There may be a plurality of hanging parts 18 formed on each protruding body 13A. For example, each of the protruding bodies 13A may have five hanging parts 18 formed therein. The plurality of hanging parts 18 may be formed at different heights.

Each of the hanging parts 18 may include a horizontal surface 18A on which the protrusion 19C is hung, and an inclined surface 18B connected to the horizontal surface 18A.

The horizontal plane 18A may be hung in contact with the bottom surface of the protrusion 19C. In other words, even if the moving bar 10 receives a force in the upward direction by the elastic force of the elastic member 12 (see FIG. 2), the horizontal surface 18A of the hanging part 18 is hung on the protrusion 19C and may not lift.

The inclined surface 18B may be formed to be inclined in a direction in which the height decreases fro the rear end of the horizontal surface 18A toward the front.

In a case where the moving bar 10 lowers, the inclined surface 18B may press the protrusion 19C rearward. In more detail, the front surface of the protrusion 19C may be inclined or rounded in a direction in which the height decreases toward the front. Accordingly, when the moving bar 10 lowers, the inclined surface 18B may be in contact with the front surface of the protrusion 19C and push the protrusion 19C rearward. Accordingly, the moving bar 10 can be smoothly lowered without being hung by the protrusion 19C.

The lower end of the inclined surface 18B of any one of the hanging parts 8 may be connected to the front end of the horizontal surface 18A of the other hanging part 18 located below one of the hanging parts 18.

The first stopper 19 may be provided with a first compression spring 16. The first compression spring 16 may provide an elastic force to the first stopper 19 in a direction in which the protrusion 19C hung on the hanging part 18. In other words, the first compression spring 16 may push the first stopper 19 forward.

The first compression spring 16 may be disposed on the outer circumference of the first stopper main body 19B. The first compression spring 16 may be located between the protrusion 19C and the connection cover 17.

When the user presses the first button 19A, the protrusion 19C may compress the first compression spring 16 by pressing it rearward. If the user does not apply force to the first button 19A, the first compression spring 16 may move the first stopper 19 forward by pressing the protrusion 19C forward.

Since the plurality of hanging parts 18 are formed at different heights, the position of the moving bar 10 and the protrusion length of the extension frame 5 with respect to the support frame 2 may vary according to the height of the hanging part 18 on which the protrusion 19C is hung.

A direction guide part 1D for guiding the mounting direction of the first stopper 19 may be formed on the inner circumference of the stopper mounting part 1B. In addition, an auxiliary protrusion 19D may be formed on the first stopper 19. The auxiliary protrusion 19D is located inside the stopper mounting part 16 and may protrude radially outward from the first stopper main body 19B. In this case, the auxiliary protrusion 19D passes through the direction guide part 1D only in a case where the first stopper 19 is inserted in the set direction, otherwise the auxiliary protrusion 19D may be hung by the direction guide part 1D.

Hereinafter, the operation of the first stopper 19 will be described.

When the user pulls the handle 10A at the lower end of the moving bar 10, the moving bar 10 may lower. When the moving bar 10 lowers, the inclined surface 18B of any one of the hanging parts 18 ray press the protrusion 19C rearward. Accordingly, the first stopper 19 may move rearward and the first compression spring 16 may be compressed between the protrusion 19C and the connecting cover 17. Since the protrusion 19C has moved rearward, the moving bar 10 may lower.

When the inclined surface 18B of any one of the hanging parts 18 is lower than the protrusion 19C, the first stopper 19 can move forward by the elastic force of the first compression spring 16, and the protrusion 19C may be hung by the other hanging part 18 located above one of the hanging parts 18. In this case, when the user pulls the handle 10A at the lower end of the moving bar 10 again, the above-described process is repeated and the moving bar 10 may lower further.

Accordingly, the user can easily adjust the protrusion length of the extension frame 4 protruding from the support frame 2 in conjunction with the elevation of the moving bar 10.

Meanwhile, when the user presses the first button 19A, the first stopper 19 may move rearward. Accordingly, the protrusion 19C can compress the first compression spring 16 without being hung by the hanging part 18.

Since the protrusion 19C is not hung by the hanging part 18, the moving bar 10 may lift by the elastic force of the elastic member 12 (see FIG. 2). Accordingly, the extension frame 5 can be inserted into the support part 4 of the support frame 2.

Accordingly, the user can simply restore the protrusion of the extension frame 5 with respect to the support frame 2 by pressing the first button 19A.

Figure 9:
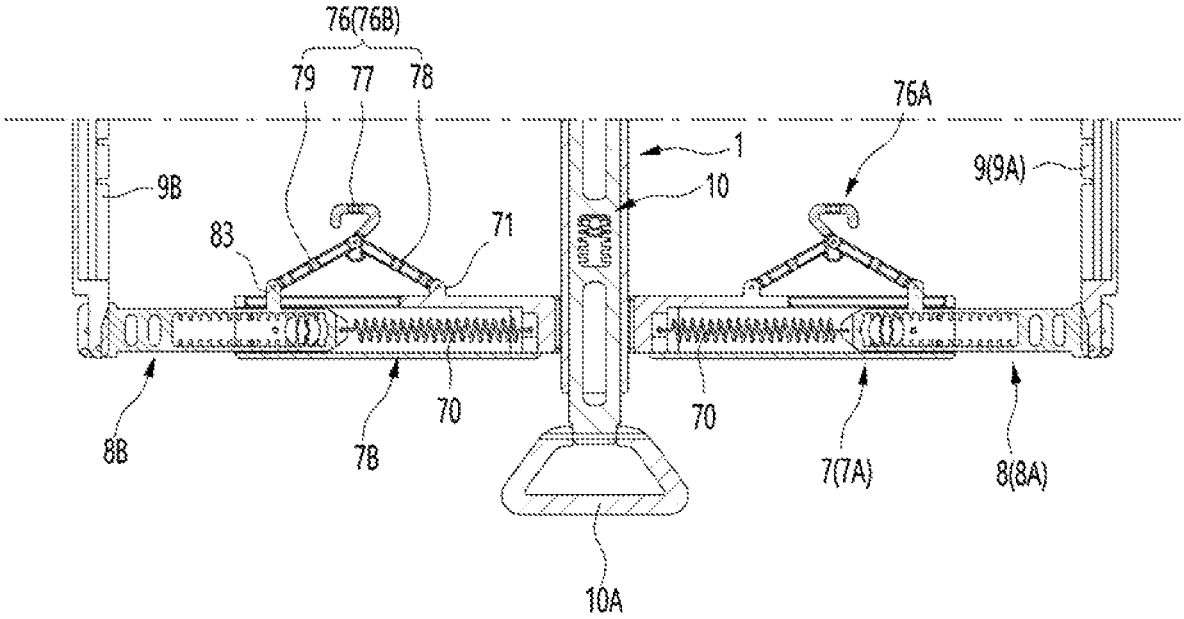
FIG. 9 is an enlarged cross-sectional view illustrating the inner portion of the lower portion of the clothing hanger according to an embodiment of the present disclosure.
Figure 10:
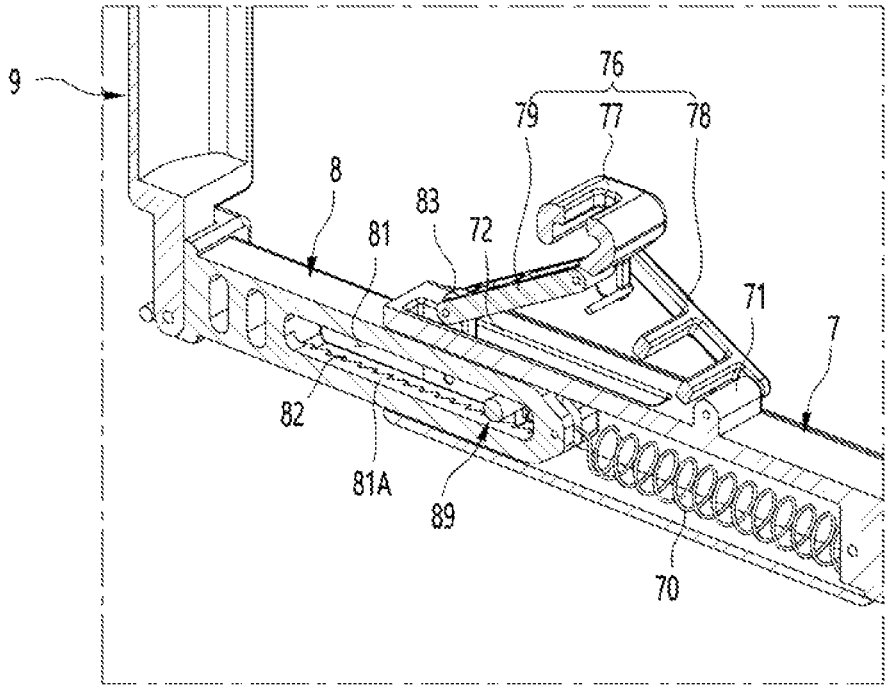
FIG. 10 is a view illustrating a connection relationship between a second stopper and a lower extension frame according to an embodiment of the present disclosure.
Figure 11:
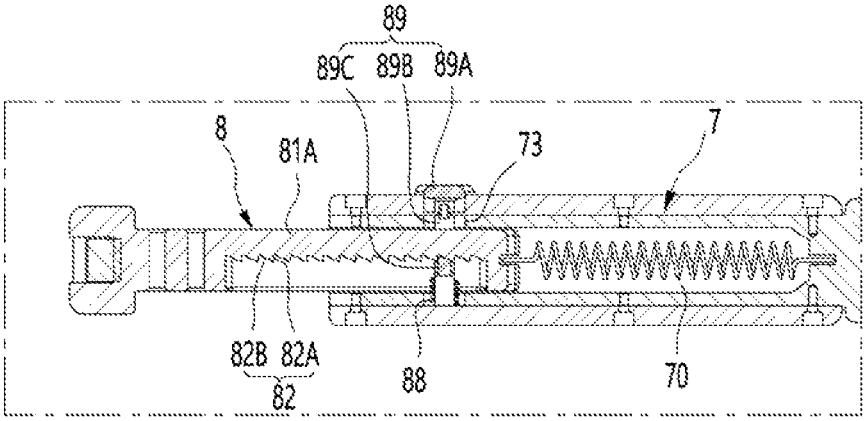
FIG. 11 is a view for explaining the operation of a second stopper according to an embodiment of the present disclosure.

FIG. 9 is an enlarged cross-sectional view illustrating the inner portion of the lower portion of the clothing hanger according to an embodiment of the present disclosure, FIG. 10 is a view illustrating a connection relationship between a second stopper and a lower extension frame according to an embodiment of the present disclosure, and FIG. 11 is a view for explaining the operation of a second stopper according to an embodiment of the present disclosure.

The clothing hanger according to an embodiment of the present disclosure may further include a second stopper 89 for preventing the lower extension frame 8 from moving into the lower frame 7.

The second stopper 89 may include a second button 89A provided on the outer surface of the lower frame 7, a second stopper main body 89B formed long in the horizontal direction from the second button 89A, and a protrusion 89C protruding from the second stopper main body 29B and hung on the lower extension frame 8.

The second button 89A may be provided on the outer surface of the lower frame 7. In more detail, a stopper through-hole 73 through which the second stopper 89 passes may be formed in a portion adjacent to the outer end portion of the front surface of the lower frame 7.

The second stopper 89 may be provided on the lower frame 7 to be movable in the horizontal direction, more specifically, in the front and rear direction. When the user presses the second button 89A, the second stopper 89 can move rearward, and when the user does not apply a force to the second button 89A, the second stopper 89 can move forward by the elastic force of the second compression spring 88.

The second stopper main body 89B may be formed long rearward from the second button 89A. The diameter of the second stopper main body 89B may be smaller than the diameter of the second button 89A.

The second stopper main body 89B may be inserted into the lower frame 7. In more detail, the second stopper main body 898 may extend from the inner portion of the stopper through-hole 73 toward the rear surface of the lower frame 7.

In addition, an opening 81 through which the second stopper main body 89B passes may be formed in the lower extension frame 8. The opening 81 may be a long hole that passes through in the front and rear direction and formed long in the left and right direction.

The protrusion 89C may protrude radially outward from the second stopper main body 89B. In more detail, the protrusion 89C may protrude from the second stopper main body 89B in the vertical direction. The protrusion 89C may be hung by the hanging portion 82 formed in the lower extension frame 8.

The hanging part 82 may be formed in the open hole 81 of the lower extension frame 8. In more detail, a protruding body 81A may be formed on the upper and lower surfaces of the inner circumference of the opening 81, and a plurality of hanging parts 82 may be formed on the rear surface of the protruding body 81A.

The pair of protruding bodies 81A may protrude in a direction closer to each other at the upper and lower sides of the inner circumference of the opening 81. The protruding body 81A may be formed long in the left and right direction.

The hanging part 82 may be formed to protrude rearward from the rear surface of the protruding body 81A.

There may be a plurality of hanging parts 82 formed on each protruding body 81A. The plurality of hanging parts 82 may be formed at different positions in the longitudinal direction of the lower extension frame 8. In other words, the plurality of hanging parts 82 may be disposed in the left and right direction.

Each of the hanging parts 82 may include a vertical surface 82A on which the protrusion 89C is hung, and an inclined surface 82B which is connected to the vertical surface 82A.

The vertical surface 82A may be hung in contact with the outer surface of the protrusion 89C. The outer surface of the protrusion 89C may mean a surface opposite to the surface facing the vertical frame 1 among both side surfaces of the protrusion 89C.

Even if the lower extension frame 8 receives a force in the direction to be inserted into the lower frame 7 by the elastic force of the tension spring 70, the vertical surface 82A of the hanging part 82 is hung by the protrusion 89C and may not move.

The inclined surface 82B may be inclined in a forward direction from the rear end of the vertical surface 82A toward the outside.

In a case where the lower extension frame 8 moves in a direction to protrude from the lower frame 7, the inclined surface 82B may press the protrusion 89C rearward. In more detail, the front surface of the protrusion 89C may be inclined or rounded in a direction toward the front toward the outside. Accordingly, when the lower extension frame 8 moves outward, the inclined surface 82B may contact the front surface of the protrusion 89C and push the protrusion 89C rearward. Accordingly, the lower extension frame 8 can move smoothly without being hung by the protrusion 89C.

The outer end of the inclined surface 82B of any one of the hanging parts 82 may be connected to the front end of the vertical surface 18A of the other hanging part 82 adjacent to one of the hanging parts 82.

The second stopper 89 may be provided with a second compression spring 88. The second compression spring 88 may provide an elastic force to the second stopper 89 in a direction in which the protrusion 89C hangs the hanging part 82. In other words, the second compression spring 88 may push the second stopper 89 forward.

The second compression spring 88 may be disposed on the outer circumference of the second stopper body 89B. The second compression spring 88 may be located between the protrusion 89C and the rear surface of the lower frame 7.

When the user presses the second button 89A, the protrusion 89C may compress the second compression spring 88 by pressing it rearward. If the user does not apply force to the second button 89A, the second compression spring 88 may press the protrusion 89C forward to move the second stopper 89 forward.

Since the plurality of hanging parts 82 are formed at different positions in the left and right direction, the protrusion length of the lower extension frame 8 with respect to the lower frame 7 can vary according to the position of the hanging part 82 on which the protrusion 89C is hung.

Hereinafter, the operation of the second stopper 89 will be described.

When the user pulls the lower extension frame 8 outward, the inclined surface 82B of any one of the hanging parts 82 may press the protrusion 89C rearward. Accordingly, the second stopper 89 may move rearward, and the second compression spring 88 may be compressed by being pressed by the protrusion 89C. Since the projection 89C has moved rearward, the lower extension frame 8 can n rove outward. In other words, the lower extension frame 8 may protrude from the lower frame 7.

When the lower extension frame 8 moves outward, the tension spring 70 connected to the lower extension frame 8 may be tensioned.

When the inclined surface 82B of any one of the hanging parts 82 moves outward than the protrusion 89C, the second stopper 89 can move forward by the elastic force of the second compression spring 88, and the protrusion 89C may be hung by the other hanging part 82 located inside one of the hanging parts 82. In this case, if the user pulls the lower extension frame 8 again, the process described above is repeated, and the lower extension frame 8 may move further.

Accordingly, the user can easily adjust the protruding length of the lower extension frame 8 protruding from the lower frame 7.

Meanwhile, when the user presses the second button 89A, the second stopper 89 may move rearward. Accordingly, the protrusion 89C may compress the second compression spring 88 without being hung by the hanging part 82.

Since the protrusion 89C is not hung by the hanging part 82, the lower extension frame 8 may move inwardly by the elastic restoring force of the tension spring 70. In other words, the lower extension frame 8 can be inserted into the lower frame 7. Accordingly, the user can simply restore the protrusion of the lower extension frame 8 with respect to the lower frame 7 by pressing the second button 89.

Figure 12:
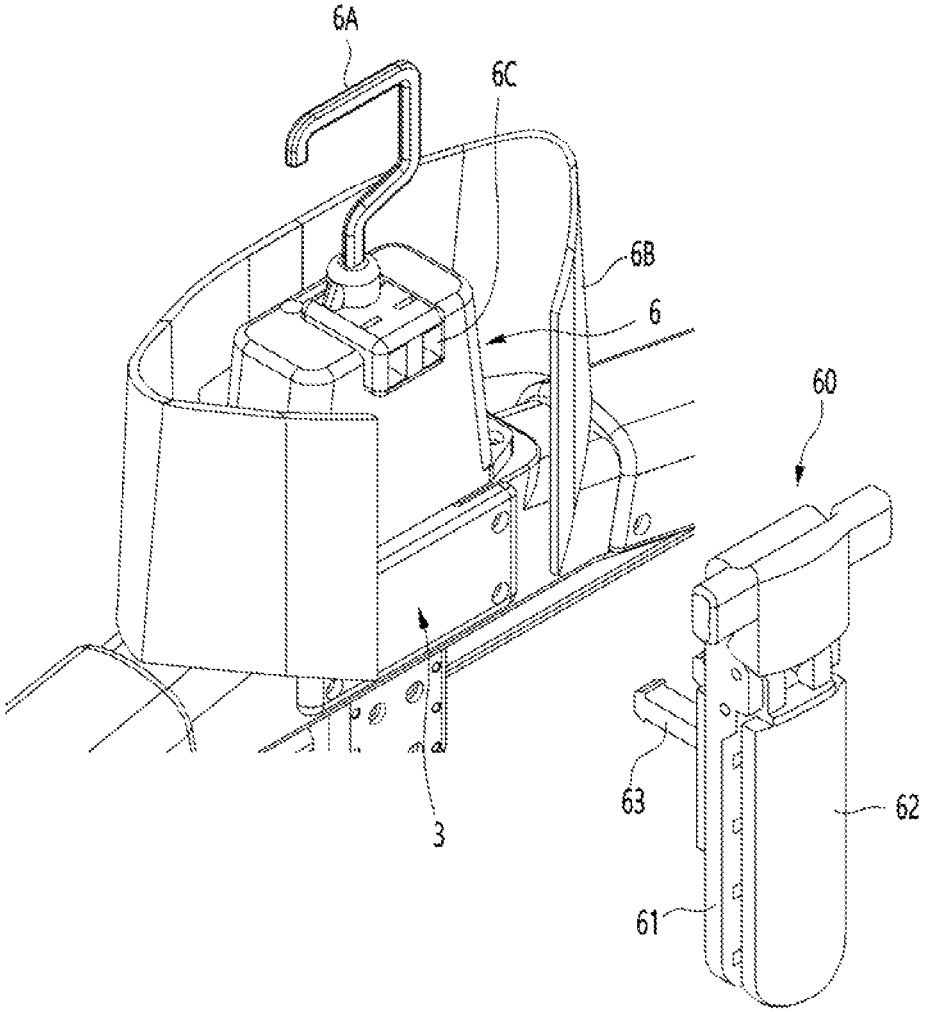
FIG. 12 is a view illustrating an elastic band and a band fixing device according to an embodiment of the present disclosure.

FIG. 12 is a view illustrating an elastic band and a band fixing device according to an embodiment of the present disclosure.

The clothing hanger according to an embodiment of the present disclosure may further include a band fixing device 60 for fixing the elastic band 6B.

The band fixing device 60 may be fastened at the front of the upper body 6. In more detail, a fastening hole 6C to which the band fixing device 60 is fastened may be formed on the front surface of the upper body 6.

The band fixing device 60 includes a main body 61, a fixing part 62 is hinged to the main body 61 to fix the elastic band 6B, and a fastening part 63 which protrudes from the rear of the main body 61 to fasten to the upper body 6.

The main body 61 may have a plate shape which is formed long in the vertical direction.

The fixing part 62 may be provided in front of the main body 61. The fixing part 62 is hinged to the main body 61 to be able to rotate in the vertical direction. Preferably, a torsion spring (not illustrated) providing an elastic force for rotating the fixing part 62 toward the main body 61 is provided on the hinge. The fixing part 62 may fix the elastic band 6B together with the main body 61. In more detail, both end portions of the elastic band 6B may be fixed between the main body 61 and the fixing portion 62.

The fastening part 63 may be formed long rearward from the rear surface of the main body 61. The fastening part 63 may be inserted into the fastening hole 6C of the upper body 6.

Since the band fixing device 60 fixes the elastic band 6B, the elastic band 6B can stably support the collar of clothing having various shapes.

According to a preferred embodiment of the present disclosure, the extension frame may protrude from both sides of the support frame. As a result, the clothing hanger can be extended in the left and right direction to stably support clothing of various sizes.

In addition, the moving bar may be interlocked with the extension frame by the elevating body and the multi-joint link. Accordingly, the user can simply extend the clothing hanger in the left and right direction by pulling the handle connected to the moving bar downward.

In addition, the elevating body can be lifted vertically in the inner space of the center part and the inner space of the upper body communicating therewith. Accordingly, the clothing hanger can be kept compact while securing enough space for the elevating body to be capable of elevating.

In addition, the upper body may be provided with an elastic band elastically deformed, the band fixing device may fix the elastic band. This allows the elastic band to stably support the collar of the clothing.

In addition, when the user presses the first button, the moving bar may move upward by the elastic force of the elastic member, and the extension frame may be inserted into the support frame. Accordingly, the clothing hangers which are extended in the left and right direction can be restored simply and conveniently.

In addition, a plurality of hanging parts to which the first stopper is hung may be formed at different heights of the moving bar. Thereby, the protrusion length of the extension frame can be easily adjusted.

In addition, the first compression spring may provide an elastic force to the first stopper in a direction in which the protrusion hangs on the hanging part. Accordingly, if the user does not apply force to the first button, the first stopper can prevent the moving bar from lifting.

In addition, the hanging part may include a horizontal surface and an inclined surface. Accordingly, in a case where the moving bar lowers, the projection does not hang on the hanging part, but in a case where the moving bar lifts, the protrusion may become hung on the hanging part.

In addition, the lower extension frame may protrude from both sides of the lower frame, and the side frame connecting the extension frame and the lower protrusion frame to each other may move outward. Accordingly, the side frame can push the clothing to both sides within the body of the clothing, and the clothing can be kept taut in the left and right direction.

In addition, the side frame may be elastically deformed to suit the shape of the clothing to apply a mechanical force.

In addition, when the user presses the second button, the lower extension frame may be inserted into the lower frame by the elastic force of the tension spring. Accordingly, the clothing hangers which are extended in the left and right direction can be restored simply and conveniently.

In addition, the plurality of hanging parts to which the second stopper is hung may be formed at different positions in the left and right direction. Thereby, the protrusion length of the lower extension frame can be easily adjusted.

In addition, the second compression spring may provide an elastic force to the second stopper in a direction in which the protrusion hangs the hanging part. Accordingly, if the user does not apply force to the second button, the second stopper may prevent the lower extension frame from moving inward.

In addition, the hanging part may include a vertical surface and an inclined surface. Accordingly, in a case where the lower extension frame moves outward, the protrusion does not hang on the hanging part, and in a case where the lower extension frame moves inward, the protrusion may become hung on the hanging part.

In addition, the hook device relay apply a mechanical force by fixing the lower portion of the clothing. Thereby, the clothing can be kept taut in the vertical direction.

In addition, the height of the hook device may be changed according to the movement of the lower extension frame. Accordingly, the mechanical force can be stably applied to clothing of various sizes.

What is claimed is:

1. A clothing hanger comprising:

a vertical frame;

a support frame including a center part connected to an upper end of the vertical frame and a pair of support parts extending from opposite sides of the center part to support clothing;

a moving bar provided in an inner portion of the vertical frame to be capable of elevating;

an elevating body connected to an upper end of the moving bar and provided in the center part to be capable of elevating;

a multi joint link which is embedded in each support part of the pair of support parts and rotatably connected to the elevating body, and a length of which varies according to the elevation of the elevating body;

an extension frame provided to be movable in an inner portion of the support frame, to be connected to the multi joint link, and to protrude outward from the support part; and an elastic member providing an upward elastic force to the moving bar.

2. The clothing hanger of claim 1, further comprising:

a handle connected to the lower end of the moving bar and to be located below the vertical frame.

3. The clothing hanger of claim 1, wherein the support frame further includes an upper body fastened on an upper side of the center part and having an inner space in which the elevating body is capable of lifting, and wherein a hook is provided on an upper portion of the upper body.

4. The clothing hanger of claim 3, wherein the upper body is provided with an elastic band which is elastically deformed and surrounds at least a portion of the upper body.

5. The clothing hanger of claim 4, further comprising:

a band fixing device which is fastened at a front of the upper body and fixes the elastic band.

6. The clothing hanger of claim 1, further comprising:

a stopper configured to prevent the lifting of the moving bar, wherein the stopper includes a button provided on an outer surface of the vertical frame;

a stopper main body extending from the button in a horizontal direction and configured to pass through the vertical frame; and a protrusion configured to protrude from the stopper main body and to hang on a hanging part of the moving bar.

7. The clothing hanger of claim 6, wherein the hanging part is provided as a plurality of hanging parts, and wherein the plurality of hanging parts are located at different heights from each other.

8. The clothing hanger of claim 6, further comprising:

a compression spring configured to provide an elastic force to the stopper in a direction in which the protrusion hangs on the hanging part.

9. The clothing hanger of claim 8, wherein the hanging part includes:

a horizontal surface on which the protrusion hangs; and an inclined surface connected to the horizontal surface and configured to press the protrusion in a direction in which the stopper compresses the compression spring.

10. The clothing hanger of claim 1, further comprising:

a pair of lower frames connected to a lower part of the vertical frame; and a lower extension frame provided movably in the inner portion of each lower frame of the pair of lower frames and configured to protrude to the outside of each lower frame.

11. The clothing hanger of claim 10, further comprising:

a side frame extending in a vertical direction and connecting the extension frame and the lower extension frame to each other.

12. The clothing hanger of claim 11, wherein the side frame is elastically deformable.

13. The clothing hanger of claim 10, further comprising:

a tension spring embedded in the lower frame and to pull the lower extension frame into the lower frame.

14. The clothing hanger of claim 13, further comprising:

a stopper configured to prevent the lower extension frame from moving into the lower frame, wherein the stopper includes:

a button provided on an outer surface of the lower frame, a main body extending in a horizontal direction from the button and configured to pass through the lower frame; and a protrusion configured to protrude from the main body and to hang on a hanging part of the lower extension frame.

15. The clothing hanger of claim 14, wherein the hanging part is provided as a plurality of hanging parts, and wherein the plurality of hanging parts are formed at different positions in a longitudinal direction of the lower extension frame.

16. The clothing hanger of claim 14, further comprising:

a compression spring configured to press the stopper in a direction in which the protrusion hangs on the hanging part.

17. The clothing hanger of claim 16, wherein the hanging part includes:

a vertical surface on which the protrusion hangs; and an inclined surface connected to the vertical surface and configured to press the protrusion in a direction in which the stopper compresses the compression spring.

18. The clothing hanger of claim 16, further comprising:

a lower hook located on an upper side of the lower frame;

a first connecting member rotatably connected to the lower hook and the lower frame, respectively; and a second connection member rotatably connected to the lower hook and the lower extension frame, respectively.

19. The clothing hanger of claim 18, wherein a connector to which the second connection member is rotatably connected is formed on an upper surface of the lower extension frame, and wherein a long hole through which the connector passes is formed on an upper surface of the lower frame.

20. A clothing hanger comprising:

a vertical frame;

a support frame including a center part connected to an upper end of the vertical frame and a pair of support parts extending from opposite sides of the center part to support clothing;

a moving bar configured to be provided to be capable of elevating in an inner portion of the vertical frame;

a multi joint link which is embedded in each support part of the pair of support parts, which is rotatably connected to the moving bar, and a length of which varies according to the elevation of the moving bar;

an extension frame configured to be provided movably inside the support frame, to be connected to the multi-joint link and to protrude outward from the support part; and an elastic member providing an upward elastic force to the moving bar.

* * * * *